United States Patent [19]

Sprunck et al.

[11] 4,093,190

[45] June 6, 1978

[54] PROCESS FOR THE PROTECTION OF A REFRACTORY WALL IN SERVICE

[75] Inventors: Emile Sprunck, Moyeuvre; Pierre Jean Leroy, St. Germain en Laye, both of France

[73] Assignee: Creusot-Loire, Paris, France

[21] Appl. No.: 761,967

[22] Filed: Jan. 24, 1977

Related U.S. Application Data

[63] Continuation-in-part of Ser. No. 590,054, June 25, 1975, abandoned, which is a continuation-in-part of Ser. No. 234,727, Mar. 15, 1972, abandoned.

[51] Int. Cl.[2] ..... C21B 7/16

[52] U.S. Cl. ..... 266/47; 266/222; 266/281

[58] Field of Search ..... 266/47, 222, 265, 266, 266/268, 270, 281

[56] References Cited

U.S. PATENT DOCUMENTS

| | | | |
|---|---|---|---|
| 2,562,813 | 7/1951 | Ogorzaly et al. | 75/34 |
| 3,206,549 | 12/1972 | Knuppel et al. | 266/222 X |
| 3,859,078 | 1/1975 | Haysom et al. | 266/222 X |
| 3,895,785 | 7/1975 | Kolb et al. | 266/222 X |
| 4,023,781 | 5/1977 | Fritz et al. | 266/268 |

*Primary Examiner*—Roy Lake
*Assistant Examiner*—Paul A. Bell
*Attorney, Agent, or Firm*—Robert D. Yeager

[57] ABSTRACT

In a process for treating a bath of molten metal in a refractory-lined metallurgical furnace by introducing oxygen into the bath, an improved method for protecting selected portions of the refractory lining against wear. Liquid hydrocarbons are controllably injected through ports in the lining located in proximity to the aforesaid selected portions so as to direct the hydrocarbons toward the selected portions and thereby prevent corrosion by constituents of the bath.

2 Claims, 3 Drawing Figures

PROCESS FOR THE PROTECTION OF A REFRACTORY WALL IN SERVICE

CROSS REFERENCE TO RELATED APPLICATIONS

This is a continuation-in-part of U.S. application Ser. No. 590,054, filed June 25, 1975 and now abandoned, which is a continuation of U.S. application Ser. No. 234,727, filed Mar. 15, 1972, now abandoned.

BACKGROUND OF THE INVENTION

1. Field of the Invention

This invention relates to an improvement in protecting the refractory lining of a metallurgical furnace, more particularly to the injection of liquid hydrocarbons through ports or tuyeres in such a furnace to discharge the hydrocarbons toward selected portions of its refractory lining.

2. Description of the Prior Art

With the advent of modern oxygen steelmaking processes in which pure oxygen is introduced into molten iron to refine it, considerable attention has been given by workers in the art to improving the life of the consumable refractory lining used in steelmaking furnaces. Much of this attention has been devoted to increasing the resistance of the refractory brick against chemical and physical erosion associated with oxygen steelmaking processes. While this effort has been generally successful to the point that many hundreds of heats may be processed during a single campaign on the lining, still further improvement in lining life has been sought by treating the refractory lining during the course of the campaign. Such treatments, however, generally have been confined to supplementing worn areas of the lining with added refractory material at a time when the furnace is not in actual use.

One popular method of lining supplementation is called "gunning". This technique involves the spraying of a refractory slurry on the worn areas of the lining by means of a pneumatically-operated spray gun. The use of "gunning" has increased lining life but it brings about some inefficiencies in furnace usage because the operation is time consuming and must be carried out between heats when the furnace is empty.

A further method of lining augmentation is described in U.S. Pat. No. 3,663,339 which is said to be an improvement in conventional "gunning" practices. This patent describes a boom which is insertable into the furnace and has secured to its inserted end a container carrying pulverulent refractory material. The container also includes an explosive charge which, when detonated, propels the refractory material against selected portions of the refractory lining. While the operation may be carried out with the furnace interior at elevated temperatures, the procedures described in U.S. Pat. No. 3,663,339 are, like "gunning", suitable for employment only when the vessel is empty. This means, of course, that the familiar operating cycle used in the basic oxygen top-blowing process, for example, must be modified to accommodate an extra operation.

SUMMARY OF THE INVENTION

Unlike the prior art methods for extending the life of a refractory lining of a metallurgical furnace, the present invention makes no attempt at resurfacing the refractory lining. Instead, the present invention involves the discharge of liquid hydrocarbons from ports or tuyeres extending through the refractory lining in such a way as to direct the liquid hydrocarbons toward selected areas of the lining that are particularly subject to attack during the course of the oxygen blowing operation. Furthermore, the discharge of liquid hydrocarbons in this manner is carried out at a time when the furnace contains a molten charge which is actively being subjected to oxygen introduction.

The hydrocarbons thusly discharged are available for chemical reaction with highly oxidized constituents of the molten bath and thereby serve as a buffer for the surface of the refractory toward which the hydrocarbons are directed. In steel refining, for example, the result is protection of the refractory against the corrosive attack of slag or liquid metal charged with iron oxide and a consequent retardation of refractory wear, making lining resurfacing operations unnecessary.

A striking feature of the present invention, therefore, is that it is practiced during the time that oxygen blowing is taking place. Accordingly, no modification of the usual furnace operation cycle is necessary in order to achieve the benefits of the present invention.

Thus, in a process for treating a bath of molten metal in a refractory-lined metallurgical furnace by introducing oxygen into the bath, the present invention comprises: controllably injecting liquid hydrocarbons through at least one port in the refractory lining located beneath the dynamic level of the bath, the port being sufficiently spaced away from the source of the oxygen introduction and the liquid hydrocarbons being injected in sufficient quantity so as to direct the hydrocarbons toward selected portions of the refractory lining and thereby retard the wear of the selected portions.

The term "dynamic level of the molten metal" as used herein means the highest level achieved by the molten bath (including slag) in the furnace during oxygen blowing operations. The term is to be distinguished from "quiescent bath level" which is the level of the molten bath during periods of nonblowing.

The foregoing and other features and advantages of the present invention will be more completely disclosed in the following detailed description, the accompanying drawings and the appended claims.

DESCRIPTION OF THE PREFERRED EMBODIMENTS

Figure 1:
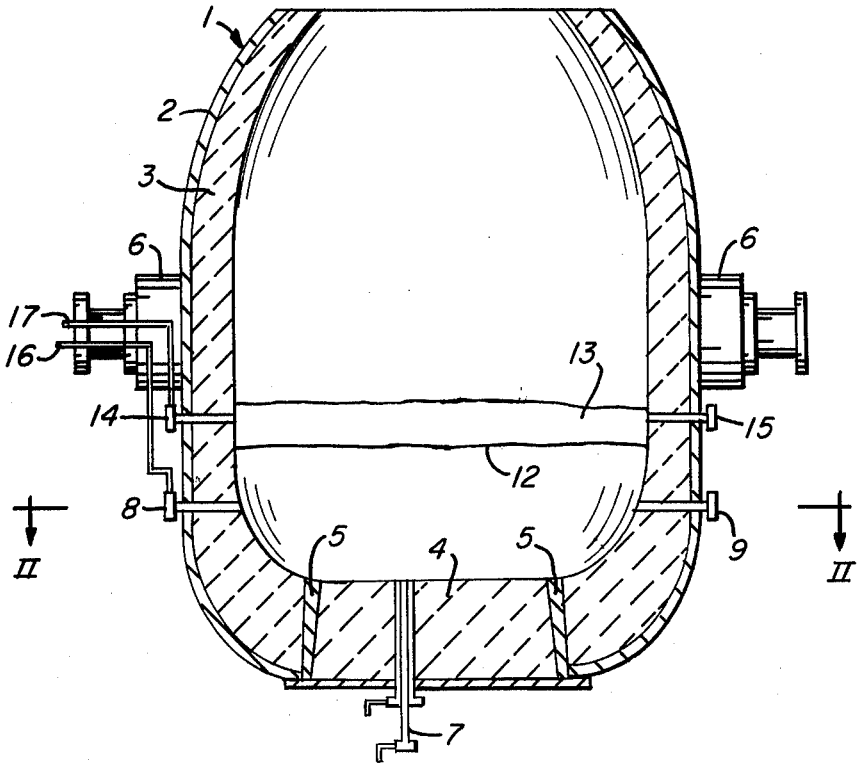
FIG. 1 is a view in side elevation partially in section illustrating a typical metallurgical furnace arranged for practicing the present invention.

Referring to FIG. 1 of the drawings, there is shown a metallurgical furnace 1 of the open-mouthed converter type. The particular converter illustrated is equipped for the practice of an oxygen bottom-blowing steelmaking process in which pure oxygen is injected into a molten iron bath from beneath its surface. Converter 1 has a steel outer shell 2 and a refractory lining 3. Since the converter is fitted for bottom blowing, it has a removable, refractory-lined bottom section 4 which joins the refractory lining 3 at joint 5. Pure oxygen is injected into the converter by means of one or more double tuyeres 7 in accordance, for example, with the process described in U.S. Pat. No. 3,817,744, whose teachings are incorporated by reference herein. Converter 1 with a fixed bottom would be suitable for the practice of the oxygen top-blowing steelmaking process in which an oxygen lance inserted into the mouth of the converter supplies oxygen to the bath from above. Converter 1 is mounted for rotation on trunnions 6.

Figure 2:
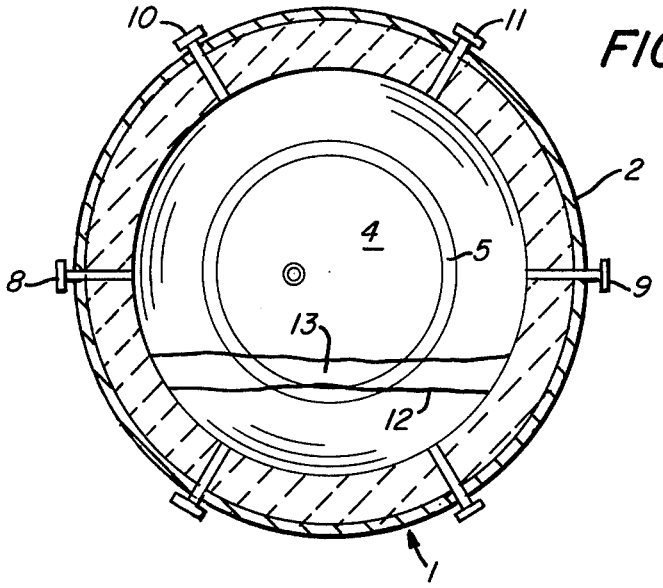
FIG. 2 is a sectional view taken along line II—II of FIG. 1, at the level of a row of tuyeres for introducing liquid hydrocarbons.

For the practice of the present invention, converter 1 is provided with ports in the refractory lining for injecting liquid hydrocarbons, such as fuel oil, through the converter shell 2 and refractory lining 3 for discharge toward selected portions of the refractory lining (or bottom) 3. These ports or tuyeres, shown in the embodiment of FIG. 1 by reference numerals 8, 9, 14 and 15, are arranged in two rows each having four tuyeres. The lower row, represented by tuyeres 8 and 9, in FIG. 1, is positioned just above the surface of bottom section 4. The remaining two tuyeres of this row, 10 and 11, are shown in FIG. 2. The tuyeres in the lower row discharge liquid hydrocarbons well below the static level 12 of the metal bath which is depicted in FIG. 1 as being overlain by slag layer 13.

The higher row of tuyeres, represented by tuyeres 14 and 15 in FIG. 1, is positioned below the axis of trunnions 6. The remaining tuyeres of this row (not shown) are located in the same relative positions as tuyeres 10 and 11 in the lower row. The tuyeres in the higher row discharge liquid hydrocarbons approximately at the static level of the slag layer 13.

As shown in FIG. 2, the four tuyeres of each row are desirably positioned at 60° from one another in one half of the converter circumference. This arrangement permits tilting of the converter on its side without submerging any of the tuyeres beneath the static metal bath level 12 or slag layer 13. "Turning down" of the converter is, of course, a commonplace operation in both top and bottom blowing steelmaking practice. While the tuyeres shown in FIG. 2 are arranged so that their axes are generally normal to the inner surface of the refractory lining, it should be understood that the tuyeres, if desired, may be positioned obliquely in the lining so that the flow of liquid hydrocarbons may be directed towards zones in the lining which are especially vulnerable to wear.

Each of the single feed tuyeres shown in FIGS. 1 and 2 consists of a tube formed of suitable material, such as copper or steel, and is supplied with liquid hydrocarbons under pressure through individual supply lines. The supply lines 16 and 17 for tuyeres 8 and 14, respectively, are shown in FIG. 1 as passing through left-hand trunnion 6 which is provided with suitable bores for the passage of these lines. As will be appreciated by those skilled in the art, there are numerous other means of providing a supply of liquid hydrocarbons to the tuyeres. As explained hereinafter, the importance of the supply arrangement is that the pressure and flow of liquid hydrocarbons be controllable for individual tuyere.

Figure 3:
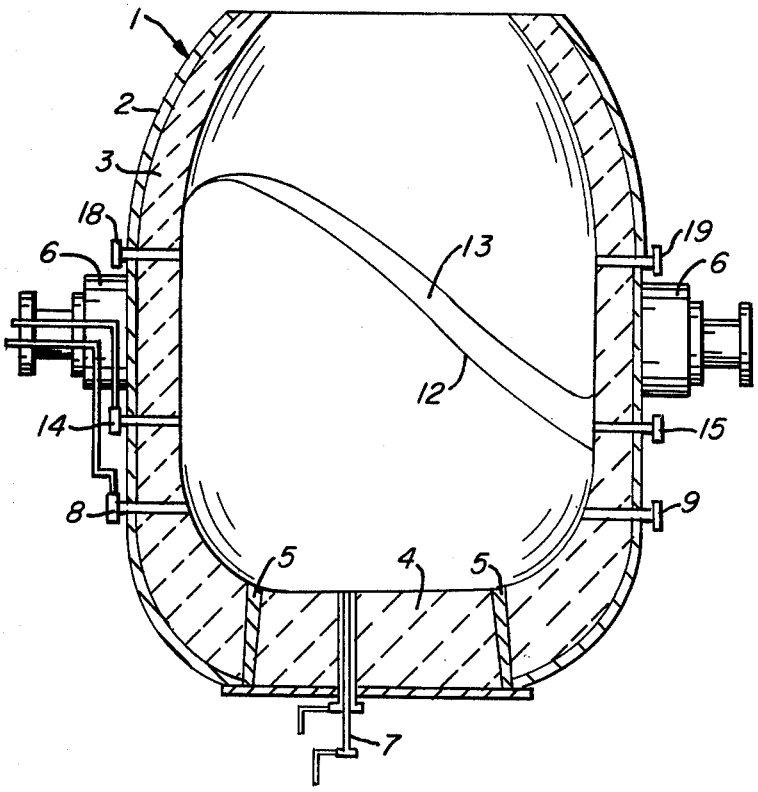
FIG. 3 is an elevational view, similar to FIG. 1, illustrating the dynamic level of the molten bath within the furnace.

FIG. 3 is a schematic illustration of the "dynamic" level of the molten bath. As is well known, the bath level during the blowing period of an oxygen steelmaking process is generally dependent upon the instantaneous value of carbon monoxide (CO) concentration in the bath. As CO bubbles form in the body of the bath from the reaction of oxygen with carbon, these bubbles expand the volume of the bath as they rise to the surface. As decarburization proceeds to a close, the volume of the bath decreases and the level of the bath subsides toward the static level.

The configuration of the upper surface of the bath during oxygen blowing is practically impossible to predict but is believed to be governed by a random circulation pattern within the bath itself. FIG. 3 merely illustrates a wave-like motion which might be encountered at some stage in the blowing, where the liquid level rises on one side of the converter and falls correspondingly on the other. The point of this discussion is that during oxygen blowing, opportunity is provided for both slag and metal, charged with FeO, to contact various zones of the refractory lining and cause wear. It may be advantageous, therefore, to position single feed tuyeres, such as shown at 18 and 19 in FIG. 3, above the trunnions 6 but still beneath the dynamic level of the bath. Single feed tuyeres likewise may be positioned in the bottom of the furnace, spaced apart from the double tuyeres 7 (which blow oxygen) in order to retard or prevent wear of the refractory bottom.

The present invention is intended for use in refractory-lined metallurgical furnaces in which oxygen treatment processes are carried out as, for example, in the refining of impure iron into steel. An important object of the invention is to provide hydrocarbons adjacent zones of the refractory lining that are susceptible to the corrosive attack of metal oxides present in the bath, and to so provide the hydrocarbons in an amount which exceeds the amount that will stoichiometrically combine with the available oxygen in these zones. Thus, the hydrocarbons discharged toward these susceptible zones of the lining, instead of the constituents of the refractory lining itself, serve as reducing agents for the bath oxides in such zones. In this manner, corrosive attack of the refractory lining is prevented.

It is well known that the lining of a particular furnace will wear unevenly during the course of a campaign and that this wear pattern will be substantially repetitive from campaign to campaign if processing conditions are not materially altered. Thus, workers familiar with a particular furnace in terms of its configuration, refractory type and placement, and with the parameters of the process carried on within the furnace, can fairly determine the zones of the refractory lining that will be most susceptible to rapid wear. These zones are the ones to which the present invention may be most advantageously applied.

In placing the tuyeres for injection of liquid hydrocarbons, it is preferred that they be spaced sufficiently away from the source of oxygen introduction to, as a minimum, prevent free gaseous oxygen from contacting the hydrocarbons. Since the oxygen is intended for use in oxidizing impurities in the bath, it would be wasteful and perhaps otherwise harmful to the process to utilize the oxygen to simply burn the hydrocarbons. Beyond this limitation, the present invention generally will function best to retard refractory wear when the liquid hydrocarbon injection tuyeres are located as far as possible from the source of oxygen introduction but in close proximity to the zones of rapid lining wear.

With respect to the quantity of liquid hydrocarbons injected through a particular tuyere in the furnace, this will depend on the instantaneous concentration of oxides present in the locality of the tuyere. Such factors as the weight and composition of the molten metal charge, oxygen purity and flow, elapsed time of the blow, furnace size and configuration, and proximity of other hydrocarbon injection tuyeres, if any, are involved in determining the quantity of liquid hydrocarbons needed to protect the surrounding refractory lining from the corrosive attack of such oxides. The practical experience of workers in the art, based on actual observation of lining wear patterns and refractory consumption rates, is the best determinate, however, of this quantity.

For a given quantity of liquid hydrocarbons to be injected by a particular tuyere, the pressure and flow rate may be suitably adjusted. Depending on the placement of the tuyere, pressure must be adjusted to overcome the hydrostatic and/or hydrodynamic pressures exerted by the molten bath on the tuyere port. Generally, the higher the tuyere in the furnace, the less injection pressure will be required to overcome these pressures. Once injection pressure is established, flow rate may be adjusted to provide the necessary quantity of liquid hydrocarbons in accordance with the above discussion. As alluded to above, the requirement for adjustability of the pressure and flow of liquid hydrocarbons feeding each tuyere may now be seen.

The pressure exerted by the bath at the tuyere port plays a role in directing the hydrocarbons toward a particular area of the refractory lining. As the liquid hydrocarbons are injected into the bath, this pressure tends to flatten and spread the stream of liquid. Depending upon the angle of the injection stream with respect to the adjacent lining surface, this tendency is used to advantage in the practice of the invention to direct the hydrocarbons toward a selected portion of the lining.

The present invention may be exemplified by its practice in a bottom-blown converter of the type illustrated in the drawings, in which converter a charge of 65 tons of molten iron is refined by pure oxygen. Each of the tuyeres used in the practice of the invention, specifically the tuyeres in the three rows shown in FIG. 3, consists of a steel tube having an inside diameter of 9 millimeters and its longitudinal axis arranged normal to the refractory wall. In the practice of the invention, the liquid hydrocarbon used in fuel oil and its flow through the tuyeres is regulated at about 0.9 liters per minute per tuyere. The fuel oil is introduced through the tuyeres at varying pressures depending on their vertical location in the converter. For example, the pressure in the lower row (e.g. tuyeres 8, 9, etc.) is 7 bars; the pressure in the middle row (e.g. tuyeres 14, 15, etc.) is 6.5 bars; and the pressure in the upper row (e.g. tuyeres 18, 19, etc.) is 6 bars. All pressures are measured by pressure gauges located upstream of the tuyeres and are adjusted to take into account (i) both the pressure drop in the circuit and in each tuyere downstream of the corresponding pressure gauge and (ii) the counter pressure of the molten metal bath and the slag. This combination of flow rate and pressure produces relatively low refractory wall wear rates, on the order of about 0.6 millimeter per charge. These rates may be contrasted with refractory wear rates on the order of about 1 millimeter per charge when the invention is not used. Any abnormally high refractory wear observed by the furnace operator may be overcome by increasing the pressure (and thus flow) of the fuel oil being introduced in the tuyere nearest the critical zone.

While much of the foregoing description is cast in terms of oxygen steelmaking practices, those persons skilled in the art will recognize the applicability of the present invention to any refractory-lined metallurgical furnace employing oxygen treatment processes.

What is claimed is:

1. In a process for treating a bath of molten metal in a refractory-lined metallurgical furnace by introducing oxygen into said bath, the improvement comprising:

controllably injecting liquid hydrocarbons through at least one single tube tuyere in said refractory lining located beneath the dynamic level of said bath, said tuyere being sufficiently spaced away from the source of said oxygen introduction to prevent free gaseous oxygen from contacting said hydrocarbons and said liquid hydrocarbons being injected in sufficient quantity so as to direct said hydrocarbons toward selected portions of said refractory lining and thereby to retard the wear of said selected portions.

2. The improvement recited in claim 1 wherein: said liquid hydrocarbons comprise fuel oil.

* * * * *

UNITED STATES PATENT AND TRADEMARK OFFICE

CERTIFICATE OF CORRECTION

PATENT NO. : 4,093,190

DATED : June 6, 1978

INVENTOR(S) : Emile Sprunck and Pierre Jean Leroy

It is certified that error appears in the above-identified patent and that said Letters Patent are hereby corrected as shown below:

Column 2, line 11, after "molten" --metal-- should be inserted.

Column 3, line 58, after "for" --each-- should be inserted.

Column 4, line 30, "these" should read --those--.

Column 5, line 39, "in" should read --is--.

Signed and Sealed this

*Thirty-first* Day of *October 1978*

[SEAL]

*Attest:*

RUTH C. MASON
*Attesting Officer*

DONALD W. BANNER
*Commissioner of Patents and Trademarks*